United States Patent [19]

Ingeveld et al.

[11] Patent Number: 4,797,302

[45] Date of Patent: Jan. 10, 1989

[54] ELECTRIC LAMP HAVING A MIRROR-COATED LAMP VESSEL

[75] Inventors: Johannes W. Ingeveld; Albert J. Westerhof, both of Weert, Netherlands

[73] Assignee: U.S. Philips Corp., New York, N.Y.

[21] Appl. No.: 137,047

[22] Filed: Dec. 23, 1987

Related U.S. Application Data

[62] Division of Ser. No. 40,450, Apr. 16, 1987, Pat. No. 4,758,761.

[30] Foreign Application Priority Data

Apr. 16, 1986 [NL] Netherlands ..... 8600955

[51] Int. Cl.[4] ..... B05D 5/12

[52] U.S. Cl. ..... 427/107; 445/13; 445/11; 148/6.3

[58] Field of Search ..... 427/107; 148/6.3; 445/11-13

[56] References Cited

U.S. PATENT DOCUMENTS 2,918,595 12/1959 Cressman ..... 427/107

*Primary Examiner*—Sam Silverberg

*Attorney, Agent, or Firm*—Brian J. Wieghaus

[57] ABSTRACT

The electric lamp has a lamp vessel (1) of which a wall portion (4) is mirror-coated at its inner surface with an aluminum layer. This wall portion (4) has a boundary (5) near the largest diameter (2) of the lamp vessel (1). This boundary (5) is adjoined by a zone (10) coated with a transparent aluminum oxide layer. In the lamp, a dark zone caused by a very thin aluminum layer adjoining the boundary (5) is avoided.

6 Claims, 1 Drawing Sheet

ELECTRIC LAMP HAVING A MIRROR-COATED LAMP VESSEL

Figure 1:
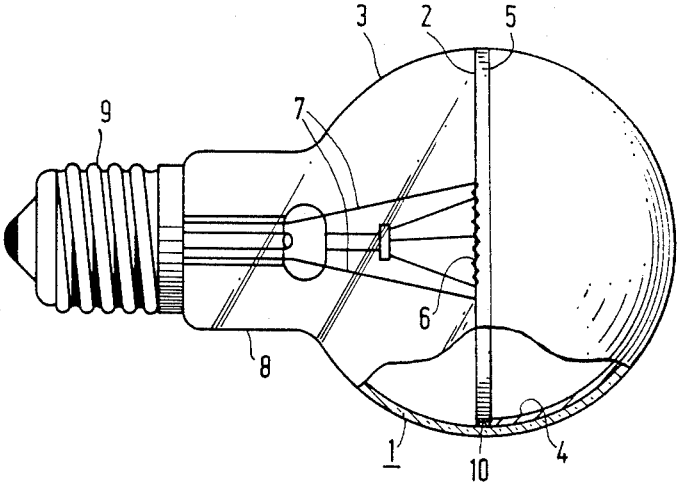

This is a division of application Ser. No. 40,450, filed Apr. 16, 1987, now U.S. Pat. No. 4,758,761.

The invention relates to an electric lamp comprising:

a blown glass lamp vessel sealed in a vacuum-tight manner and having a largest diameter, a translucent wall portion and a wall portion which is mirror-coated on its inner surface with an aluminium layer, this mirror-coated wall portion having a boundary near the largest diameter of the lamp vessel;

a light source arranged in the lamp vessel;

current supply conductors extending through the wall of the lamp vessel to the light source. Such a lamp is known from European Patent Specification 0 022 304 (PHN.9536).

Lamps of the kind described in the aforementioned European Patent Specification are manufactured by evaporating aluminium in the lamp vessel at a reduced pressure. For this purpose, a filament carrying a piece of aluminium is temporarily arranged in the lamp vessel. By current passage through this filament the aluminium is heated and evaporated. Unless this source of aluminium vapour is screened in part, substantially the whole lamp vessel is mirror-coated with a layer of aluminium.

Wall portions that would have had to remain without a mirror-coating, can be freed from their aluminium layer in that they are brought into contact with lye. A sharp transition can then be obtained between wall portions that are mirror-coated and wall portions that are not mirror-coated. However, disadvantages of this manufacturing method are that the lye has to be completely removed by carefully washing the lamp vessel, that the lamp vessel has to be dried thoroughly, that the lye and the washing water used have to be made harmless for the environment and that there is a risk of the reflect:ve layer being damaged by spatters of lye or washing-water.

Because of these diaadvantages of the partial removal of a reflective coating, it is very attractive to be able to apply a reflective layer only at the areas at which it is desirable. The wall portion not to be coated could be covered with a mask. In most cases, however, this requires a mask which is larger than an opening in the lamp vessel (its neck), through which this mask has to be introduced. It has been suggested to use foldable masks which are expanded within the lamp vessel, but such masks are complicated and expensive. They have a short life because they soon cannot be fully expanded or folded any longer due to the fact that aluminium is deposited on them.

A simple and suitable method of partly mirror-coating a lamp vessel consists in that a screen is provided close to the vapour source, as a result of which a part of the wall of the lamp vessel lies in the shadow of this screen during evaporation of the aluminium. However, this method has the disadvantage that a part of the wall of the lamp vessel lies in a half-shadow. The lamp manufactured by this method has the disadvantage that a very thin alumilnium layer has formed on the wall of the lamp vessel during evaporation at the area of the half-shadow. This very thin translucent aluminium layer becomes manifest as a black zone which adjoins the mirror-coated wall portion at the area at which the screen would have had to prevent deposition of aluminium near the largest diameter of the lamp vessel.

The said half-shadow is caused by the fact that the vapour source is not infinitely small, but in view of the surface to be covered has a certain minimum volume. The half-shadow is also caused by the fact that aluminium vapour is exposed to the scattering effect of the residual gas in the lamp vessel on its way from the vapour source to the wall of the lamp vessel. The mirror-coating step is effected at reduced pressure, for example at 0.1 to 0.01 Pa, because an unacceptably long processing period would be involved in producing a high vacuum.

The dark zone limiting in the known lamp the mirror-coated wall portion is disadvantageous. The zone causes the lamp to have an unaesthetic appearance and has an adverse effect on its quality impression. The zone does not reflect incident light from the light source efficiently, but does not transmit that light substantially completely either.

The invention has for its object to provide a lamp of the kind described, which can be readily manufactured and in which nevertheless the effect of the said half-shadow is counteracted.

According to the invention, this object is achieved in an electric lamp of the kind mentioned in the opening paragraph in that the inner surface of the lamp vessel has a zone which is coated with a transparent aluminium oxide layer and adjoins the boundary of the mirror-coated wall portion near the largest diameter of the lamp vessel.

It has surprisingly proved to be possible to remove the dark zone limiting a mirror-coated wall portion which is obtained by evaporation of aluminium with the use of a screen near the vapour source. This dark zone can moreover be removed very rapidly and a very sharp boundary (without a meander) of the mirror-coated wall portion can be the result. It has been found that, when the dark zone is heated in air for a short time, a conversion of aluminium into aluminium oxide is obtained, which adjoins the mirror-coated wall portion as a hardly visible whitish haze. Further, a part of the aluminium evaporates.

The heat treatment may be carried out by means of a burner having a sharply defined flame, but may alternatively be carried out by means of a laser, for example, a neodymium-doped yttrium-aluminium-garnet laser. The lamp vessel may be rotated about an axis at right angles to the boundary of the mirror-coated wall portion along the front of the heat source. A lamp vessel can thus be treated in a very short time, for example 1 second. The use of such a laser has the additional advantage that its heat is substantially not absorbed by the glass of the lamp vessel. Thus, stresses are prevented from being produced in the glass. If the heat source, for example a burner, heats the glass of the lamp vessel above its lowest transition temperature, i.e. in the case of lamp glass about 495° C., it is recommendable to eliminate stresses in the glass by gradually cooling the glass. In general, however, stresses can be prevented from being built up in the glass by keeping the temperature just below the lowest transition temperature.

Upon accurate observation, the zone with the aluminum oxide layer is visible on a transparent wall portion as a whitish haze. The latter does not adversely affect the appearance of the lamp. However, the aluminum oxide layer can be clearly observed by means of Auger Electron Spectroscopy (AES).

The zone with the aluminum oxide layer (Z) was examined by means of AES (t=0) with respect to the presence of Al, O and Si. After the measurement, there was sputtered with $Ar^+$ ions for 1 minute and measured again (t=1). A third measurement was carried out after sputtering for another 1 minute (t=2). The same examination was carried out on the mirror-coated wall portion (M) and on the wall of another lamp vessel at the area at which an aluminum layer was removed by etching with lye (E). The results are indicated in Table 1.

TABLE 1

| t (min) | | O (at %) | Al (at %) | Si (at %) |
|---|---|---|---|---|
| 0 | Z | 57 | 43 | n.d. |
| | M | 65 | 35 | n.d. |
| | E | 65 | 2 | 33 |
| 1 | Z | 58 | 36 | 6 |
| | M | 2 | 98 | n.d. |
| | E | 65 | 1 | 34 |
| 2 | Z | 58 | 24 | 18 |
| | M | 1 | 99 | n.d. |
| | E | 65 | n.d. | 35 |

n.d. = not detectable

It appears therefrom that the mirror (M) consists at its surface (t=0) of aluminium oxide and at areas located more deeply (t=1; 2) of aluminium metal. A wall portion which is freed from an aluminium layer by etching (E) has at its surface (t=0) a very small quantity (2 at.%) of aluminium in oxidic form; below this surface this quantity is halved (t=1) and nihil (t=2), respectively. The zone of the lamp according to the invention (Z) on the contrary consists at the surface (t=0) completely of aluminium oxide (no silicon is found). Below the surface the content of silicon increases (t=1; 2). Also at this area the aluminium present is in the oxidic form, as was also apparent from the signal of a spectrometer.

The film of aluminium oxide, which is at the surface substantially free from silicon, is characteristic of the zone in the lamp according to the invention, in contrast with a glass surface of a wall portion freed from a reflective aluminium layer by etching, this glass surface having very small residues of oxidic aluminium.

The electric lamp according to the invention may have as a light source a filament or a pair of electrodes in an ionizable gas.

The mirror-coated wall portion may have different forms, such as the form of a ring in the case of a reflector lamp and substantially the form of a hemisphere in the case of a bowl mirror lamp.

Figure 2:
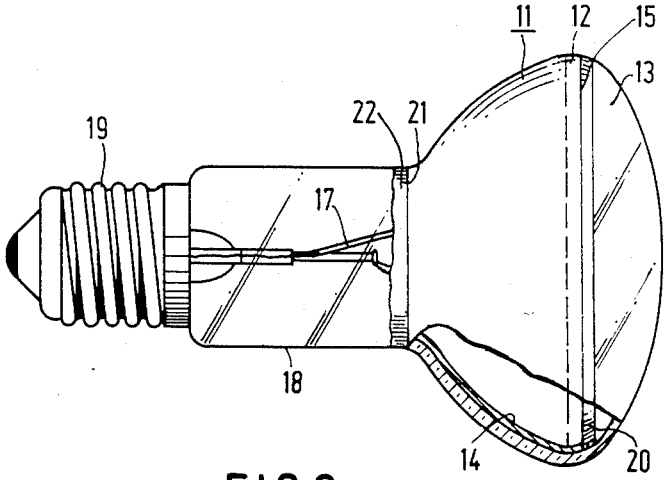

Embodiments of the lamp according to the invention are shown in the drawing. The drawing shows, partly broken away:

in FIG. 1 a bowl mirror lamp in side elevation, in FIG. 2 a ring mirror lamp in side elevation.

In FIG. 1, the bowl mirror lamp comprises a blown glass lamp vessel 1 sealed in a vacuum-tight manner and having a largest diameter 2, a transparent wall portion 3 and a wall portion 4 which is mirror-coated on its inner surface with an aluminium layer and has a boundary 5 near the largest diameter 2 of the lamp vessel 1. A filament 6 is arranged as a light source in the lamp vessel 1 and current supply conductors 7 extend through the wall of the lamp vessel 1 to this filament 6. The lamp vessel has a neck-shaped wall portion 8 at the area at which the lamp vessel 1 is sealed, this wall portion carrying a lamp cap 9. The inner surface of the lamp vessel 1 has a zone 10 which is coated with a transparent aluminium oxide layer and which adjoins the boundary 5 of the mirror-coated wall portion 4 near the largest diameter 2 of the lamp vessel 1.

In FIG. 2, corresponding parts are designated by a reference numeral which is 10 higher than in FIG. 1. In this Figure, the mirror-coated wall portion 14 is annular and has a second boundary 21 located in the neck-shaped wall portion 18. This boundary 21 is adjoined by a zone 22 which has an aluminium layer of only small thickness, as a result of which it has a dark appearance. The zone 22 is of little importance because a reflective layer in this zone is of no importance for the concentration of light and because in this zone no useful light could emanate either in case case the coating were absent. Furthermore, this zone is not disturbing because the part of the lamp in which this zone is located is generally situated during operation within a luminaire or lamp holder.

In contrast to the transparent wall portion 13, which has a diameter larger than that of the neck-shaped wall portion 18, the zone 22 and the remaining part of the neck-shaped wall portion 18 facing the lamp cap 19 can readily be screened by a mask from the vapour source during the application of the aluminium layer. During the application of the aluminium layer, the neck-shaped wall portion 18 then does not yet exhibit a narrowed part near the lamp cap 19, as shown in the Figure, but is widened at this area so that, if desired, a mask of the desired size may readily be introduced.

If desired, however, the zone 22 may also be thermally converted into a zone with a transparent aluminium oxide layer.

The bowl mirror lamp of FIG. 1 may also have an annular mirror-coated wall portion if a light window is present opposite to the lamp cap 9. A similar zone with a transparent aluminium coating may be present at the boundary between th mirror-coated wall portion and this window.

What is claimed is:

1. A method of forming a sharp boundary on an aluminum mirror coating in an electric lamp envelope, said method comprising:

(a) providing a lamp envelope having a transparent wall portion adjoining an aluminum mirror coated portion on it's inner surface, said mirror coated portion having a border region comprising a layer of aluminum thinner than said mirror coated portion; and (b) heating said border region to convert the thinner layer of aluminum to a layer of substantially aluminum oxide for forming said boundary.

2. A method as claimed in claim 1, wherein said heating of said boundary region is accomplished by a burner having a sharply defined flame.

3. A method as claimed in claim 1, wherein said heating of said boundary region is accomplished by a laser.

4. A method as claimed in claim 2, wherein said heating of said boundary region is accomplished by a neodymium-doped yttrium-aluminum-garnet laser.

5. A method as claimed in claim 2, wherein said lamp envelope is symmetrical and said boundary region is an annulus on a plane transverse to the axis of symmetry, said heating step further comprises aligning said burner with said boundary region and rotating said envelope about the axis of symmetry.

6. A method as claimed in claim 3, wherein said lamp envelope is symmetrical and said boundary region is an annulus on a plane transverse to the axis of symmetry, said heating step further comprises aligning said laser with said boundary region and rotating said envelope about the axis of symmetry.

* * * * *